US009751126B2

(12) United States Patent
Seo et al.

(10) Patent No.: US 9,751,126 B2
(45) Date of Patent: Sep. 5, 2017

(54) METHOD FOR CONTROLLING SURFACE QUALITY OF ULTRA-LOW CARBON STEEL SLAB

(71) Applicant: Hyundai Steel Company, Incheon (KR)

(72) Inventors: Hae Young Seo, Seoul (KR); Suk Hyun Yoo, Dangjin-si (KR); Hyo Joong Kwon, Dangjin-si (KR); Yeong Joo Do, Seo-gu Daegu (KR); Kae Young Lee, Chungcheongbuk-do (KR); Ju Tae Choi, Seoul (KR)

(73) Assignee: Hyundai Steel Company, Dong-gu (KR)

( * ) Notice: Subject to any disclaimer, the term of this patent is extended or adjusted under 35 U.S.C. 154(b) by 161 days.

(21) Appl. No.: 14/770,746

(22) PCT Filed: Dec. 26, 2013

(86) PCT No.: PCT/KR2013/012212

§ 371 (c)(1),
(2) Date: Aug. 26, 2015

(87) PCT Pub. No.: WO2014/133255

PCT Pub. Date: Sep. 4, 2014

(65) Prior Publication Data

US 2016/0008876 A1 Jan. 14, 2016

(30) Foreign Application Priority Data

Feb. 27, 2013 (KR) ..... 10-2013-0020963
Apr. 30, 2013 (KR) ..... 10-2013-0048326
Apr. 30, 2013 (KR) ..... 10-2013-0048881

(51) Int. Cl.
*B22D 11/16* (2006.01)
*B22D 11/00* (2006.01)

(52) U.S. Cl.
CPC ..... *B22D 11/16* (2013.01); *B22D 11/001* (2013.01)

(58) Field of Classification Search
CPC ..... B22D 11/00; B22D 11/001; B22D 11/16
See application file for complete search history.

(56) References Cited

U.S. PATENT DOCUMENTS

2009/0277600 A1* 11/2009 Cho ..... B22D 11/108 164/415

FOREIGN PATENT DOCUMENTS

JP 11-138238 A 5/1999
JP 2008087046 A 4/2008
(Continued)

OTHER PUBLICATIONS

Harada et al., "A Formation Mechanism of Transverse Cracks on CC Slab Surface", ISIJ International, vol. 30 (1990) No. 4, pp. 310-316.*

(Continued)

*Primary Examiner* — Kevin E Yoon
*Assistant Examiner* — Jacky Yuen
(74) *Attorney, Agent, or Firm* — Locke Lord LLP; Howard M. Gitten

(57) ABSTRACT

The present invention provides a method for controlling the surface quality of an ultra-low carbon steel slab, the method comprising the steps of: measuring the phosphorus (P) concentration, sulfur (S) concentration and superheating degree of a molten steel which is introduced into a mould in a continuous casting process for producing the ultra-low carbon steel slab, the width of the mould, and the casting speed of the slab; and calculating the depth of a hook which is formed when the molten steel is solidified into the slab, based on the measured width of the mould, the measured phosphorus (P) concentration, sulfur (S) concentration and (Continued)

superheating degree of the molten steel, and the measured casting speed of the slab.

6 Claims, 11 Drawing Sheets

(56) References Cited

FOREIGN PATENT DOCUMENTS

| | | | | |
|---|---|---|---|---|
| KR | 0140324 | B | | 7/1998 |
| KR | 20050002222 | A | | 1/2005 |
| KR | 20050002223 | A | | 1/2005 |
| KR | 20050021961 | A | | 3/2005 |
| KR | 20100096833 | A | | 9/2010 |
| KR | 20120097064 | A | | 9/2012 |
| KR | 20130099318 | A | * | 9/2013 |

OTHER PUBLICATIONS

Machine Translation of Choi et al (KR20050002222 A, Jan. 7, 2005) (cited in IDS).*

International Search Report for PCT/KR2013/012212 dated Mar. 26, 2014.

State Intellectual Property Office of P.R. China, Office Action dated Mar. 25, 2016, issued in corresponding Chinese Patent Application Serial No. 201380073787.8.

Institute of Materials, Minerals and Mining, Published by Maney on Behalf of the Institute, received on May 21, 2008; Prediction and Control of Subsurface Hooks in Continuos Cast Ultra-Low-Carbon Steel Slabs, by G.-G. Lee et al, Ironmaking and Steelmaking, vol. 36, No. 1, 2009.

China Academic Journal Electronic Publishing House, 2015; 'Influence of Chemical Composition on Formation of the Transverse Crack in CC Slab', by Wu Wei—Shanghai Baosteel Group Corporation; Shanghai Metals vol. 26 No. 1 of Jan. 2004.

* cited by examiner

METHOD FOR CONTROLLING SURFACE QUALITY OF ULTRA-LOW CARBON STEEL SLAB

CROSS-REFERENCE TO RELATED APPLICATIONS

This application is the national phase under 35 U.S.C. §371 of PCT International Application No. PCT/KR2013/012212, filed Dec. 26, 2013, which claims benefit and priority of Korean Application No. 10-2013-0020963, filed Feb. 27, 2013; Korean Application No. 10-2013-0048326, filed Apr. 30, 2013; and Korean Application No. 10-2013-0048881, filed Apr. 30, 2013, the entire contents of the aforementioned applications are hereby incorporated herein by reference.

FIELD OF THE INVENTION

The present invention relates to a method for controlling the surface of an ultra-low carbon steel slab.

BACKGROUND OF THE INVENTION

Molten steel is produced into steel products, such as slabs, blooms, billets or the like, through a continuous casting process. In the continuous casting process, molten steel flows from a tundish through a submerged nozzle into a mold, and is cooled through passage through the mold to produce a steel product, for example, a slab. When the molten steel passes through the submerged nozzle into the mold, argon gas is introduced to the molten steel in order to prevent the molten steel from being solidified in the submerged nozzle. When the molten steel passes through the mold, a solidified shell is formed along the surface coming in contact with the mold. If argon gas is trapped in the solidified shell, it will cause pinhole defects immediately below the surface layer of the resulting slab. The pinhole defects may evolve into line defects in the resulting hot-rolled and cold-rolled coils.

The background art of the present invention is disclosed in Korean Patent Laid-Open Publication No. 10-2005-0021961 (Mar. 7, 2005; entitled "Method for Producing Ultra-Low Carbon Steel").

SUMMARY OF THE INVENTION

Embodiments of the present invention are intended to provide a method for controlling the surface quality of an ultra-low carbon steel slab, which enables to estimate the surface quality of the slab to be produced, based on a hook depth calculated by measuring the concentrations of phosphorus and sulfur in molten steel, the casting speed of the slab, etc.

In accordance with an embodiment of the present invention, there is provided a method for controlling the surface quality of an ultra-low carbon steel slab, the method comprising the steps of: measuring the phosphorus (P) concentration, sulfur (S) concentration and superheating degree of a molten steel which is introduced into a mold in a continuous casting process for producing the ultra-low carbon steel slab, the width of the mold, and the casting speed of the slab; and calculating the depth of a hook which is formed when the molten steel is solidified into the slab, based on the measured width of the mold, the measured phosphorus (P) concentration, sulfur (S) concentration and superheating degree of the molten steel, and the measured casting speed of the slab.

The step of calculating the depth of the hook may comprise calculating the depth of the hook from the following equation 1:

$$Y=A0\ \ln(A1\times A4/(A2\times A3\times A5))+B \qquad \text{Equation 1}$$

wherein A1: the width of the mold; A2: the superheating degree; A3: the casting speed; A4: the sulfur (S) concentration; A5: the phosphorus (P) concentration; Y: the depth of the hook; A0: a coefficient; and B: a constant.

In Equation 1, A0 and B may satisfy the following equation 2:

$$0.51\leq A0\leq 0.94;$$

$$-0.21\leq B\leq 0.11 \qquad \text{Equation 2}$$

wherein A1: the width (mm) of the mold; A2: the superheating degree (K); A3: the casting speed (m/min); A4: the sulfur (5) concentration (wt %); A5: the phosphorus (P) concentration (wt %); Y: the depth (mm) of the hook; A0: a coefficient; and B: a constant.

In addition, the method of the present invention may further comprise, after the step of calculating the depth of the hook, a step of changing the casting speed to control the depth of the hook, if the calculated depth of the hook is deeper than the preset depth of the hook.

In accordance with another embodiment of the present invention, the method of the present invention may further comprise, after the step of calculating the depth of the hook, a step of changing the superheating degree to control the depth of the hook, if the calculated depth of the hook is deeper than the preset depth of the hook.

In accordance with still another embodiment of the present invention, the method of the present invention may further comprise, after the step of calculating the depth of the hook, a step of scarfing the surface of the ultra-low carbon steel slab based on the calculated depth of the hook.

The ultra-low carbon steel slab may have a carbon content of 0.01 parts by weight or less based on 100 parts by weight of the ultra-low carbon steel slab.

According to embodiments of the present invention, pinhole defects in an ultra-low carbon steel slab can be efficiently removed by estimating the surface quality of the slab based on the depth of a hook and scarfing the slab to a suitable depth based on the estimated surface quality.

DETAILED DESCRIPTION OF THE PREFERRED EMBODIMENTS

Figure 1:
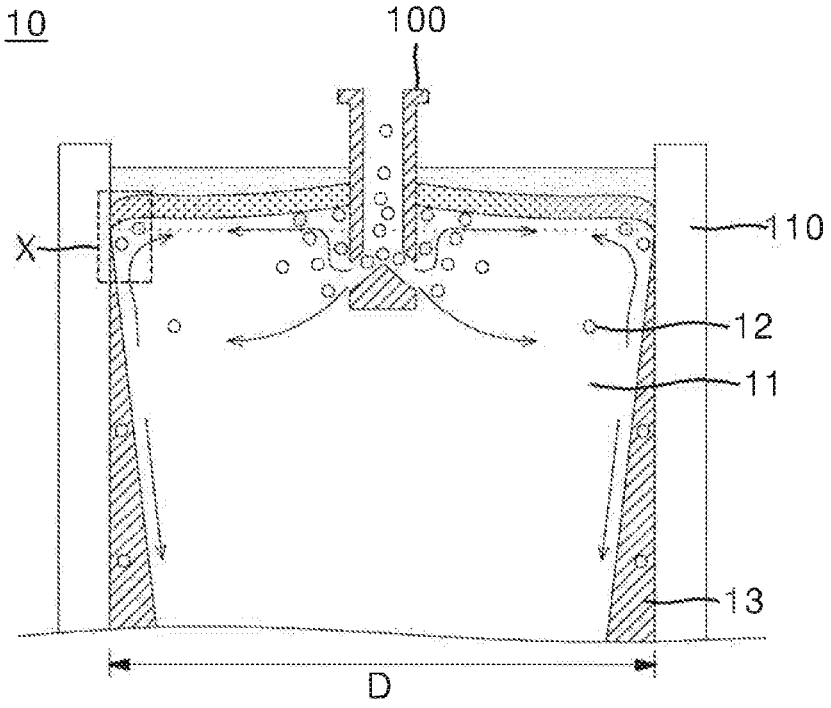
FIG. 1 is a schematic view showing continuous casting, in accordance with the invention.

The present invention may be subjected to various modifications, and may have various embodiments. Specific embodiments are illustrated in drawings, and will be described in the detailed description of the present invention. However, this is not intended to limit the present invention to specific embodiments. It should be understood that the present invention includes all modifications, equivalents or replacements that fall within the spirit and technical range of the present invention. In the following description, the detailed description of related known technology will be omitted when it may obscure the subject matter of the present invention.

The terms "first", "second", etc., may be used to describe various components, but the components are not limited by the terms. The terms are used only for the purpose of distinguishing a component from other components.

Terms used in the specification are used only to describe a specific embodiment and are not intended to limit the scope of the present invention. Singular expressions include plural expressions unless otherwise specified in the context thereof. In the specification, the terms "comprise", "have", etc., are intended to denote the existence of mentioned characteristics, numbers, steps, operations, components, parts, or combinations thereof, but do not exclude the probability of existence or addition of one or more other characteristics, numbers, steps, operations, components, parts, or combinations thereof.

Hereinafter, an embodiment of a method for controlling the surface quality of an ultra-low carbon steel slab according to the present invention will be described in detail with reference to the accompanying drawings. In the following description with reference to the accompanying drawings, like components are denoted by like reference numerals, and the descriptions of the components will not be repeated.

FIG. 1 is a view showing continuous casting. Referring to FIG. 1, a continuous casting apparatus 10 can produce an ultra-low carbon steel slab from molten steel resulting from a steel-making process. The continuous casting apparatus 10 may include a tundish (not shown), a submerged nozzle 100 and a mold 110.

The tundish is configured to receive molten steel resulting from a steel-making process.

The submerged nozzle 100 is connected with the tundish and configured to guide the molten steel from the tundish into the mold 110. In addition to the molten steel 11, argon (Ar) gas is fed into the mold 110 through the submerged nozzle 100. Argon gas 12 can prevent the molten steel 11 from being solidified in the submerged nozzle 100. The mold 110 may be made of a material having high thermal conductivity for example, copper, so that the molten steel 11 can be cooled and solidified when it passes through the mold 110. Reference numeral "D" represents the width of the mold 110.

In the upper portion of the mold 110, a powder layer composed of fed powder is formed. The powder layer includes a solid powder layer (SF) (FIG. 2) in which powder is present in a fed state, and a liquid powder layer (LF) formed by the dissolution of powder caused by the molten steel 11. The liquid powder layer (LF) functions to maintain the temperature of the molten steel 11 in the mold 110 and block the penetration of foreign matter. A boundary is formed between the liquid powder layer (LF) and the molten steel, and it is referred to as the molten steel surface (M).

Either bubbles of argon gas introduced into the mold 110 together with the molten steel 11 introduced through the submerged nozzle 100, or inclusion in the molten steel 11, are trapped in a hook, and the trapped bubbles and inclusions continue to remain. For this reason, pinhole defects occur immediately below the surface layer of the resulting product such as a slab. The created pinhole defects evolve into line defects in a process of forming the produced product into hot-rolled and cold-rolled coils, thereby deteriorating the quality of the final product. For this reason, a slab having pinhole defects should be subjected to a scarfing process of cutting out the slab surface to a certain thickness. Therefore, in order to minimize the occurrence of defects, it is required to previously estimate the occurrence of defects in a continuous casting process.

Figure 2:
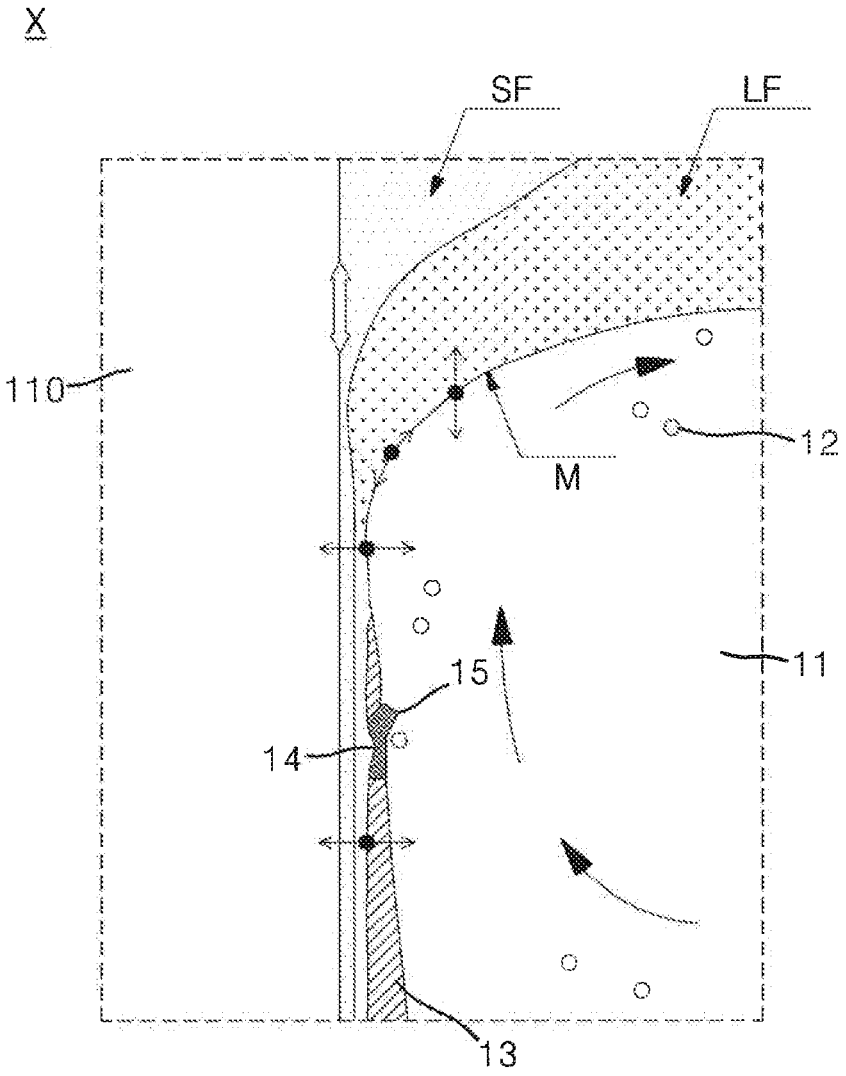
FIG. 2 is an enlarged view of portion X shown in FIG. 1.
Figure 3:
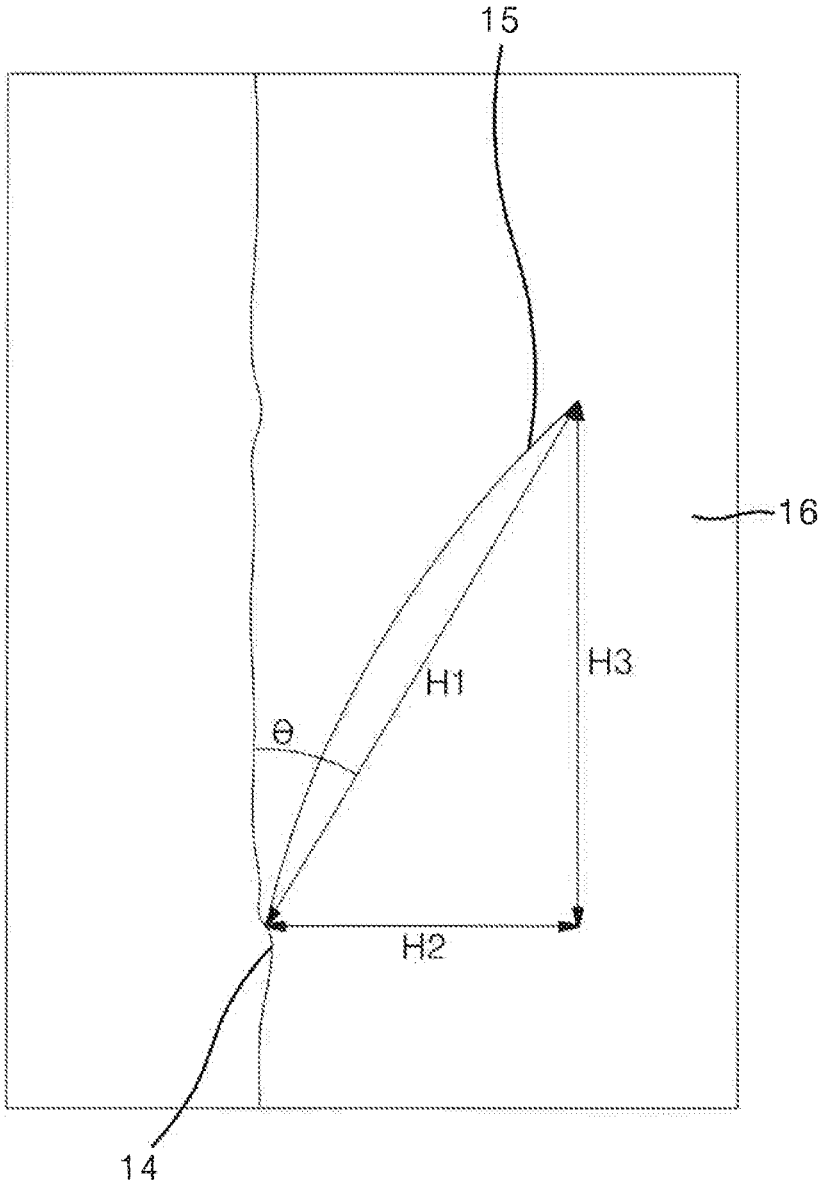
FIG. 3 is a schematic view of a hook formed within a carbon steel slab.
Figure 4:
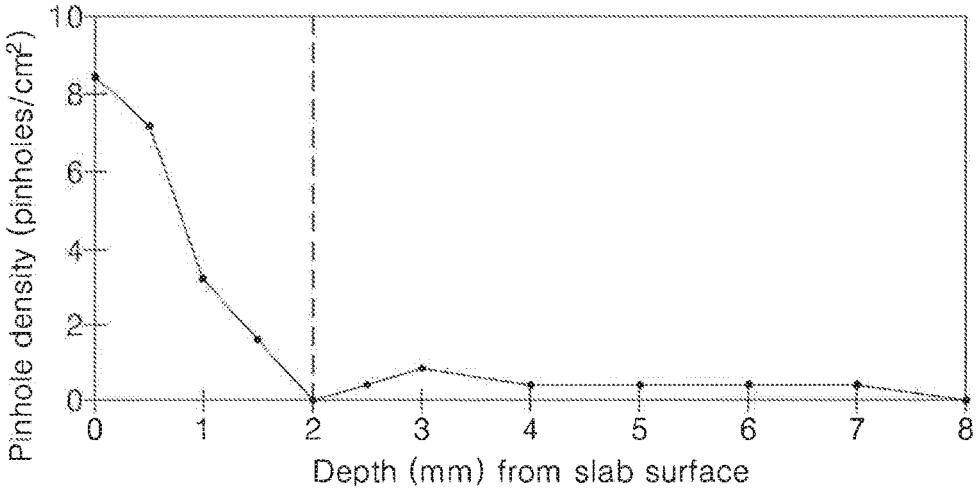
FIG. 4 is a graph showing the density of pinholes in a slab when a hook is formed to a depth of 2.0 mm.

FIG. 2 is an enlarged view of portion X shown in FIG. 1; FIG. 3 is an enlarged view of a hook; FIG. 4 is a graph showing the density of pinholes in a slab when a hook is formed to a depth of 2.0 mm; and FIG. 5 is a graph showing the density of pinholes in a slab when a hook is formed to a depth of 1.1 mm.

Referring to FIG. 2, the molten steel 11 introduced into the mold 110 forms a solidified shell 13 along the inner surface of the mold 110. The thickness of the solidified shell 13 increases as it moves downward, and ultimately, a completely solidified slab is produced. The mold 110 moves up and down periodically, and for this reason, an oscillation mark 14 and a hook 15 are formed on the surface of the solidified slab. If argon gas 12 is trapped in the hook, it will cause pinhole defects immediately below the surface layer of the resulting slab.

Referring to FIG. 3, the oscillation mark 14 is formed on the surface of the slab 16, and the hook 15 is formed in the oscillation mark 14 so as to be toward the inside of the slab 16. In FIG. 3, H1 represents the length of the hook 15; H2 represents the depth of the hook 15; H3 represents the height of the hook 15; and θ represents the slope of the hook 15. As the length H1 of the hook 15 increases or the slope θ of the hook 15 increases, the hook 15 is more bent toward the inside of the slab 16, and thus the possibility of formation of pinhole defects caused by the trapping of argon gas in the hook 15 increases. In other words, as the depth H2 of the hook increases, the possibility of formation of pinhole defects increases. This can be seen from a comparison of the test results shown in FIGS. 4 and 5.

Figure 5:
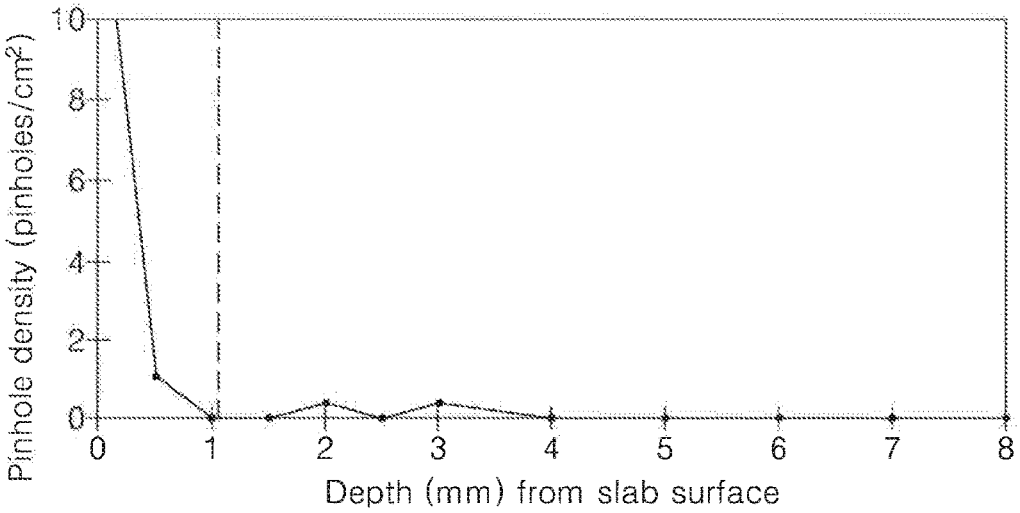
FIG. 5 is a graph showing the density of pinholes in a slab when a hook is formed to a depth of 1.1 mm.

Referring to FIGS. 4 and 5, it can be seen that the depth from the slab surface in which pinholes are intensively distributed is almost equal to the depth of the hook. Thus, according to the method for controlling the surface quality of an ultra-low carbon steel slab according to the present invention, pinholes in the slab product can be removed by calculating the depth of the hook and scarfing the slab surface to a depth corresponding to the calculated hook depth.

An ultra-low carbon steel slab can be produced by introducing molten steel into the continuous casting apparatus.

The molten steel 11 introduced into the tundish of the continuous casting apparatus 10 is introduced into the mold 110 through the submerged nozzle 100. The molten steel 11 introduced into the mold 110 forms a solidified shell 13 along the inner surface of the mold 110. The thickness of the solidified shell 13 increases as it goes downward, and thus an ultra-low carbon steel slab 16 in a completely solidified state is produced.

The ultra-low carbon steel slab 16 may have a carbon content of 0.01 parts by weight or less based on 100 parts by weight of the ultra-low carbon steel slab 16. In other words, given the total weight of the ultra-low carbon steel slab 16 is 100 parts by weight, the weight of carbon contained in the ultra-low carbon steel slab 16 may be 0.01 parts by weight or less.

Because the mold 110 of the continuous casting apparatus 10 moves up and down periodically, the oscillation mark 14 and the hook 15 are formed on the surface of the solidified slab 16. When argon gas 12 together with the molten steel 11 is introduced into the mold 110 through the submerged nozzle 100, the argon gas 12 can be trapped in the hook during the formation of the solidified shell 13.

Figure 8:
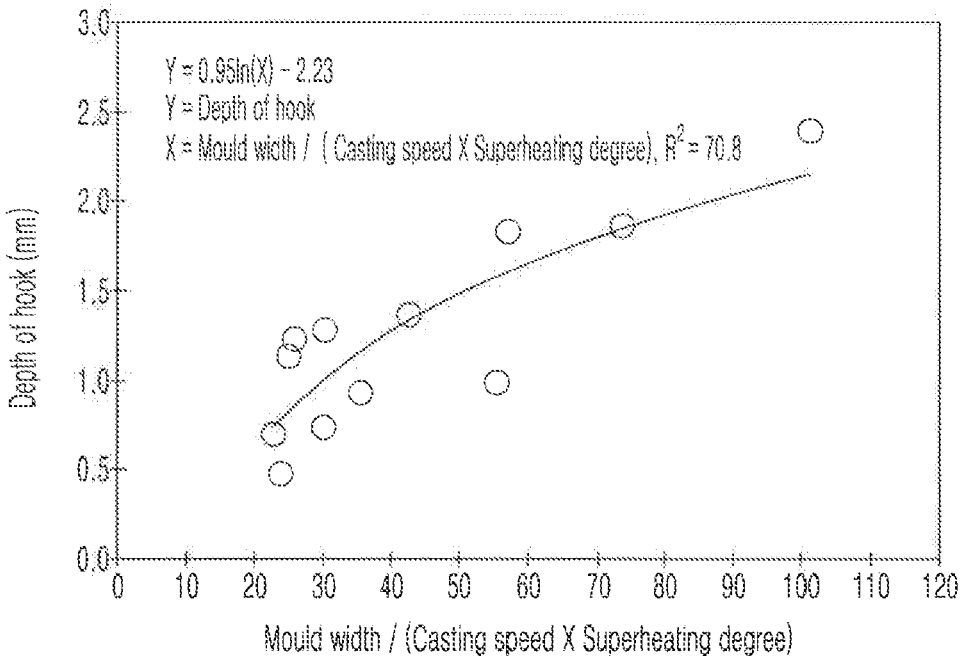
FIG. 8 is a graph showing the correlation between the following fractional expression and the depth of a hook: mold width/(casting speed×superheating degree)

FIG. 8 is a graph showing the correlation between the following fractional expression and the depth of a hook: mold width/(casting speed×superheating degree). The depth of the hook can be calculated from the width of the mold, the superheating degree (temperature) of the molten steel and the casting speed of the ultra-low carbon steel slab in the continuous casting apparatus.

The width of the mold 110 in the continuous casting apparatus 10 can be obtained by measuring the width D. The superheating degree of the molten steel means the difference between the temperature of the molten steel which is supplied to the mold and the theoretical solidification temperature of the molten steel. The temperature of the molten steel supplied to the mold can be obtained by measuring the temperature of the molten steel 11 that is supplied to the mold 110 through the submerged nozzle 100, and the theoretical solidification temperature of the molten steel can be obtained by using the previously measured solidification temperature or measuring the temperature of the surface of the mold 110 in which the solidified shell 13 is formed. The casting speed of the ultra-low carbon steel slab 16 that is completely solidified in the continuous casting apparatus 10 can be obtained by measuring the descending speed of the ultra-low carbon steel slab 16 in the mold 110.

Referring to FIG. 8, it can be seen that the depth of the hook has a correlation with the width of the mold, the superheating temperature of the molten steel and the casting speed of the ultra-low carbon steel slab. The correlation between these factors may be expressed as the regression equation shown in FIG. 8 through regression analysis.

Figure 9:
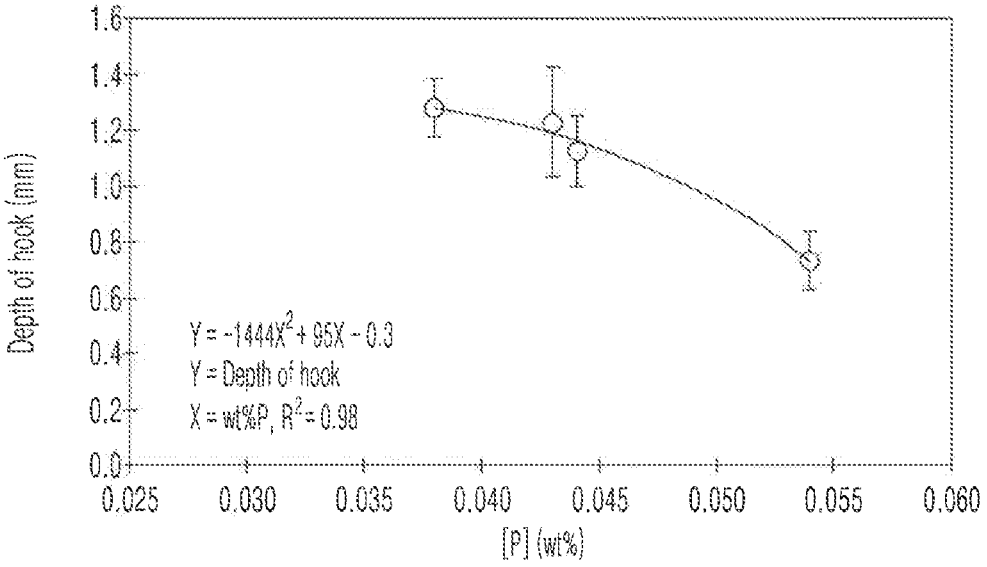
FIG. 9 is a graph showing the correlation between the concentration of sulfur and the depth of a hook.
Figure 10:
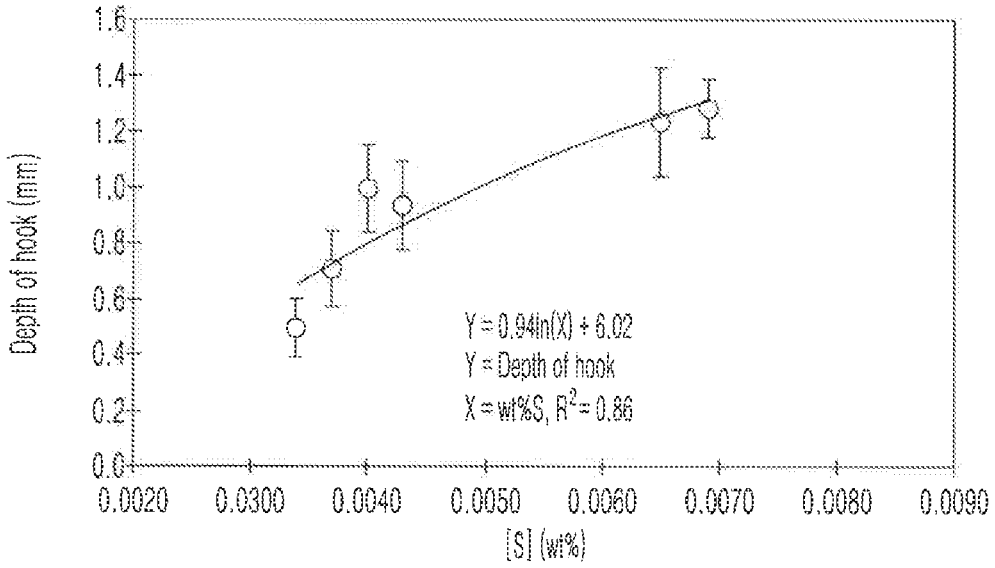
FIG. 10 is a graph showing the correlation between the concentration of phosphorus and the depth of a hook.

FIG. 9 is a graph showing the correlation between the concentration of sulfur and the depth of a hook; FIG. 10 is a graph showing the correlation between the concentration of phosphorus and the depth of a hook; and FIG. 11 is a graph showing the correlation between the following fractional expression and the depth of a hook: mold width× sulfur concentration/(casting speed×superheating degree× phosphorus concentration).

Referring to FIGS. 9 and 10, it can be seen that the concentrations of sulfur (S) and phosphorus (P) among the components of steel have a correlation with the depth of the hook. The correlation between these factors may be expressed as the regression equations shown in FIGS. 9 and 10 through regression analysis.

The width of the mound, the superheating degree of the molten steel and the casting speed of the ultra-low carbon steel slab can be obtained as described above, the concentration of sulfur and the concentration of phosphorus can be obtained by measuring the concentrations of sulfur and phosphorus in the molten steel 11 that is supplied to the mold 110 through the submerged nozzle 100.

Figure 11:
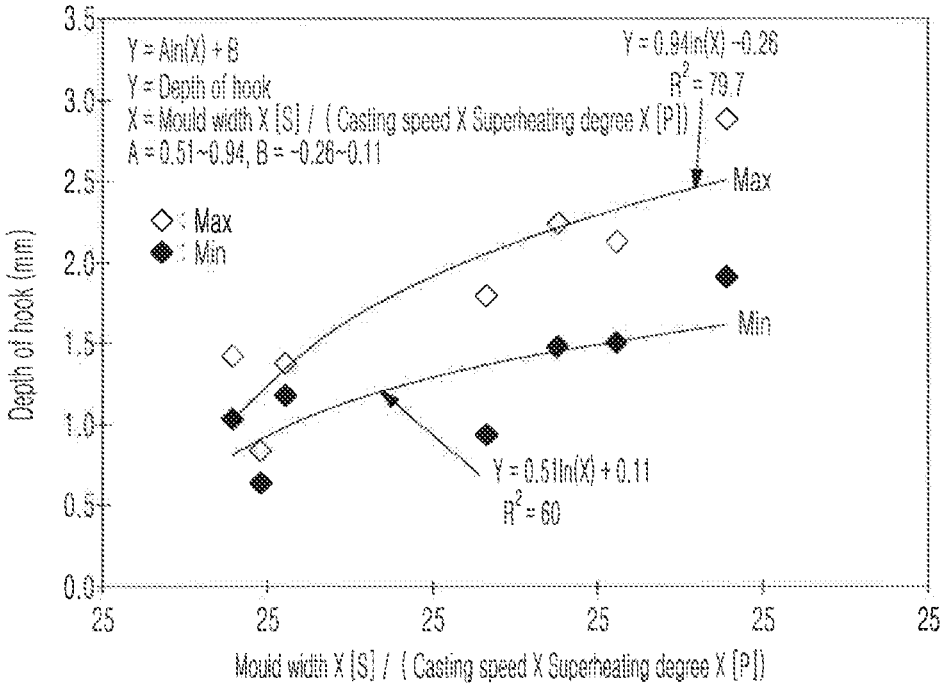
FIG. 11 is a graph showing the correlation between the following fractional expression and the depth of a hook and the value of the mold width×sulfur concentration divided by (casting speed×superheating degree×phosphorus concentration).

Referring to FIG. 11, the depth of the hook has a correlation with the width of the mold, the superheating degree of the molten steel, the concentrations of sulfur (S) and phosphorus (P) in the molten steel, and the casting speed of the ultra-low carbon steel slab. The correlation between these factors may be expressed as the regression equation shown in FIG. 11 through regression analysis. The regression equation shown in FIG. 11 can be represented by the following equation 1:

$$Y=A0\ \ln(A1\times A4/(A2\times A3\times A5))+B \qquad \text{Equation 1}$$

wherein A1 represents the width (mm) of the mold; A2 represents the superheating degree (K); A3 represents the casting speed (m/min); A4 represents the concentration (wt %) of sulfur (S); A5 represents the concentration (wt %) of phosphorus (P); Y represents the depth (mm) of the hook; A0 represents a coefficient; B represents a constant; and A0 and B can satisfy $0.51 \le A0 \le 0.94$ and $-0.21 \le B \le 0.11$, respectively.

Figure 6:
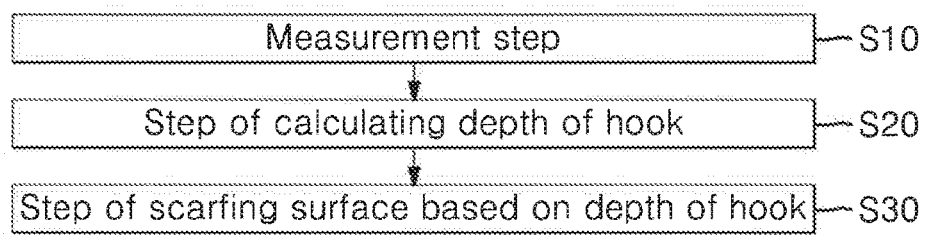
FIG. 6 is a flow chart showing a method for controlling the surface quality of an ultra-low carbon steel slab according to an embodiment of the present invention.

FIG. 6 is a flow chart showing a method for controlling the surface quality of an ultra-low carbon steel slab according to an embodiment of the present invention.

Referring to FIG. 6, a method for controlling the surface quality of an ultra-low carbon steel slab according to an embodiment of the present invention comprises the steps of: (S10) measuring the phosphorus (P) concentration, sulfur (S) concentration and superheating temperature of a molten steel which is introduced into a mold in a continuous casting process, the width of the mold, and the casting speed of the slab; (S20) calculating the depth of a hook based on the values measured in step (S10); and (S30) scarfing the surface of the slab based on the depth of the hook.

After the depth of the hook formed in the ultra-low carbon steel slab was calculated, the surface of the ultra-low carbon steel slab is scarfed based on the depth of the hook.

As described above, it can be seen that the distance from the slab surface in which pinhole defects are intensively distributed is substantially equal to the depth of the hook. Thus, when the surface of the slab is scarfed to at least the calculated depth of the hook, pinhole defects can be mostly removed. If the ultra-low carbon steel slab is scarfed to a depth equal to the calculated depth of the hook, pinhole defects can be mostly removed while the ultra-low carbon steel slab can be prevented from being lost due to excessive scarfing.

Figure 7:
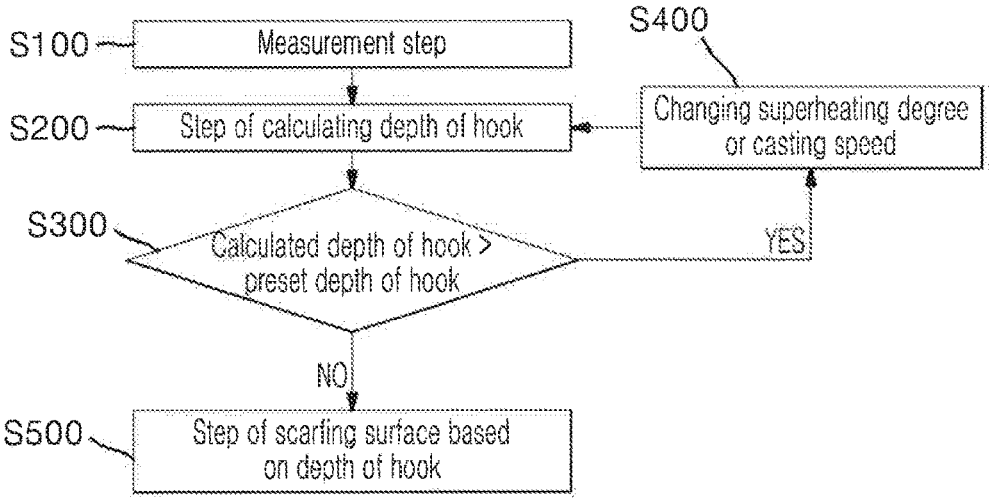
FIG. 7 is a flow chart showing a method for controlling the surface quality of an ultra-low carbon steel slab according to another embodiment of the present invention.

FIG. 7 is a flow chart showing a method for controlling the surface quality of an ultra-low carbon steel slab according to another embodiment of the present invention.

Referring to FIG. 7, a method for controlling the surface quality of an ultra-low carbon steel slab according to another embodiment of the present invention may comprise the steps of measuring the phosphorus (P) concentration, sulfur (S) concentration and superheating degree of a molten steel which is introduced into a mold in a continuous casting process, the width of the mold, and the casting speed of the slab in a first step (S100). In a further step (S200) the depth of a hook is calculated as a function of the values measured in step (S100) using Equations 1 and 2 by way of example. In a step (S300) the calculated depth of the hook is compared with a preset depth of the hook. If the calculated depth of the hook is greater than a preset depth of the hook, then in a step (S400) at least one of the superheating degree of the molten steel or the casting speed is changed to control the depth of the hook, and the process is repeated in step (S200). If the calculated depth of the hook is not deeper than the preset depth of the hook, then in a step (S500) an amount of scarfing of the surface of the slab is performed as a function of the calculated depth of the hook.

Specifically, if the calculated depth of the hook is deeper than the preset depth of the hook, the depth of the hook is controlled by either changing the superheating degree among the phosphorus (P) concentration, sulfur (S) concentration and superheating temperature of the molten steel, the width of the mold, and the casting speed of the slab, or changing the casting speed. Herein, it is not preferable to change the phosphorus (P) concentration and sulfur (S) concentration of the molten steel, because these concentrations required for each steel are fixed. In addition, because it is not easy to change the width of the mold, the depth of the hook can be controlled by changing the superheating temperature of the molten steel or the casting speed of the slab, which are relatively easy to control, rather than changing the width of the mold.

If the superheating degree of the molten steel or the casting speed of the slab is controlled as described above, the depth of the hook that is formed upon the solidification of the molten steel can be controlled to reduce the number of pinholes formed in the surface of the slab, thereby improving the surface quality of the ultra-low carbon steel slab.

Although some embodiments have been provided to illustrate the present disclosure in conjunction with the drawings, it will be apparent to those skilled in the art that the embodiments are given by way of illustration only, and that various modifications and equivalent embodiments can be made without departing from the spirit and scope of the present disclosure. The scope of the present disclosure should be limited only by the accompanying claims.

DESCRIPTION OF REFERENCE NUMERALS USED IN THE DRAWINGS

M: molten steel surface;
SF: solid powder layer;
LF: liquid powder layer;
10: continuous casting apparatus;
11: molten steel;
12: argon gas;
13: solidified shell;
14: oscillation mark;
15: hook;
16: slab;
100: submerged nozzle;
110: mold.

The invention claimed is:

1. A method for controlling a surface quality of an ultra-low carbon steel slab, the method comprising the steps of:

measuring of a phosphorus (P) concentration of a molten steel which is introduced into a mold in a continuous casting process for producing the ultra-low carbon steel slab, measuring of a sulfur (S) concentration of the molten steel, measuring a superheating temperature of the molten steel, measuring a width of the mold, and measuring a casting speed of the ultra-low carbon steel slab; and calculating a depth of a hook which is formed when the molten steel is solidified into the slab, as a function of the measured width of the mold, the measured phosphorus (P) concentration of the molten steel, the measured sulfur (S) concentration of the molten steel, the measured superheating degree of the molten steel, and the measured casting speed of the slab, calculating the depth of the hook utilizing the following equation:

$$Y=A0\ln(A1\times A4/(A2\times A3\times A5))+B$$

wherein A1 is the width of the mold; A2 is the superheating temperature; A3 is the casting speed; A4 is the sulfur (S) concentration; A5 is the phosphorus (P) concentration; Y is the depth of the hook; A0 is a coefficient; and B is a constant, wherein $0.51\leq A0\leq 0.94$; and $-0.21\leq B\leq 0.11$; and changing the casting speed to control the depth of the hook, when the calculated depth of the hook is deeper than a preset depth of the hook.

2. A method for controlling a surface quality of an ultra-low carbon steel slab, the method comprising the steps of:

measuring of a phosphorus (P) concentration of a molten steel which is introduced into a mold in a continuous casting process for producing the ultra-low carbon steel slab, measuring of a sulfur (S) concentration of the molten steel, measuring a superheating temperature of the molten steel, measuring a width of the mold, and measuring a casting speed of the ultra-low carbon steel slab; and calculating a depth of a hook which is formed when the molten steel is solidified into the slab, as a function of the measured width of the mold, the measured phosphorus (P) concentration of the molten steel, the measured sulfur (S) concentration of the molten steel, the measured superheating degree of the molten steel, and the measured casting speed of the slab, calculating the depth of the hook utilizing the following equation:

$$Y=A0\ln(A1\times A4/(A2\times A3\times A5))+B$$

wherein A1 is the width of the mold; A2 is the superheating temperature; A3 is the casting speed; A4 is the sulfur (S) concentration; A5 is the phosphorus (P) concentration; Y is the depth of the hook; A0 is a coefficient; and B is a constant, wherein $0.51\leq A0\leq 0.94$; and $-0.21\leq B\leq 0.11$; and changing the superheating degree to control the depth of the hook, when the calculated depth of the hook is deeper than a preset depth of the hook.

3. A method for controlling a surface quality of an ultra-low carbon steel slab, the method comprising the steps of:

measuring of a phosphorus (P) concentration of a molten steel which is introduced into a mold in a continuous casting process for producing the ultra-low carbon steel slab, measuring of a sulfur (S) concentration of the molten steel, measuring a superheating temperature of the molten steel, measuring a width of the mold, and measuring a casting speed of the ultra-low carbon steel slab; and calculating a depth of a hook which is formed when the molten steel is solidified into the slab, as a function of the measured width of the mold, the measured phosphorus (P) concentration of the molten steel, the measured sulfur (S) concentration of the molten steel, the measured superheating degree of the molten steel, and the measured casting speed of the slab, calculating the depth of the hook utilizing the following equation:

$$Y=A0\ln(A1\times A4/(A2\times A3\times A5))+B$$

wherein A1 is the width of the mold; A2 is the superheating temperature; A3 is the casting speed; A4 is the sulfur (S) concentration; A5 is the phosphorus (P) concentration; Y is the depth of the hook; A0 is a coefficient; and B is a constant, wherein $0.51 \leq A0 \leq 0.94$; and $-0.21 \leq B \leq 0.11$; and scarfing a surface of the ultra-low carbon steel slab as a function of the calculated depth of the hook.

4. The method of claim 1, wherein the ultra-low carbon steel slab has a carbon content of 0.01 parts by weight or less based on 100 parts by weight of the ultra-low carbon steel slab.

5. The method of claim 2, wherein the ultra-low carbon steel slab has a carbon content of 0.01 parts by weight or less based on 100 parts by weight of the ultra-low carbon steel slab.

6. The method of claim 3, wherein the ultra-low carbon steel slab has a carbon content of 0.01 parts by weight or less based on 100 parts by weight of the ultra-low carbon steel slab.

* * * * *